United States Patent [19]

Cortlever

[11] Patent Number: 4,664,560

[45] Date of Patent: May 12, 1987

[54] PROFILE TO FORM A WATERTIGHT SCREEN IN THE GROUND AND METHOD OF DISPOSING THE SAME

[76] Inventor: Nico G. Cortlever, Baambrugse Zuwe 220 P. O. Box 750, 1180 AT Vinkeveen, Netherlands

[21] Appl. No.: 614,806

[22] Filed: May 29, 1984

[30] Foreign Application Priority Data

May 31, 1983 [NL] Netherlands ..... 8301918

[51] Int. Cl.[4] ..... E02D 19/12; E02D 31/02

[52] U.S. Cl. ..... 405/258; 405/109; 405/267

[58] Field of Search ..... 405/258, 267, 274, 278, 405/281, 36, 52, 109

[56] References Cited

U.S. PATENT DOCUMENTS

| | | | |
|---|---|---|---|
| 912,020 | 2/1909 | Neilson | 405/281 |
| 3,302,412 | 2/1967 | Hunsucker | 405/278 |
| 3,465,532 | 9/1969 | Belder | 405/275 |
| 4,182,087 | 1/1980 | Schall et al. | 405/278 X |
| 4,249,836 | 2/1981 | Schmednecht | 405/267 |
| 4,430,027 | 2/1984 | Hughes et al. | 405/267 X |
| 4,519,729 | 5/1985 | Clarke et al. | 405/258 |

FOREIGN PATENT DOCUMENTS

| | | |
|---|---|---|
| 1060329 | 6/1959 | Fed. Rep. of Germany . |
| 2492864 | 4/1982 | France . |
| 7012601 | 3/1971 | Netherlands . |

*Primary Examiner*—David H. Corbin

*Attorney, Agent, or Firm*—John P. Snyder

[57] ABSTRACT

A pair of sections each has a thin main body portion with male and female interlocking means along opposite side edges. The male interlocking means of one section is connected with the female interlocking means of the adjacent section in dovetail interlocking fashion to provide an intimate fit therebetween. The terminal ends of the inwardly turned flanges of the female interlocking means of one section are disposed closely adjacent the opposite sides of the main body of the adjacent section. A trough is defined within a recess in the female interlocking means and has sealing means disposed therein.

5 Claims, 5 Drawing Figures

Figure 1:
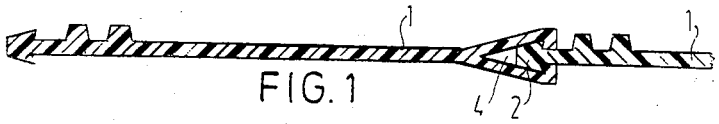

PROFILE TO FORM A WATERTIGHT SCREEN IN THE GROUND AND METHOD OF DISPOSING THE SAME

The invention relates to profiles of a watertight screen, said profiles being interconnected by means of locks continuously extending in the direction of length and being adapted to form the screen in the ground for inhibiting groundwater movements at the areas of building pits, weirs rubbish dumps, industrial sites and the like.

Such screens are arranged at least by part of their length in the ground to fulfil a soil arresting function. The resultant dam wall screen should, therefore, be soil-tight. Apart therefrom, dam walls are driven in full length in the ground with the purpose of inhibiting groundwater movements transverse of the dam wall screen. A type of profile interconnectable by locks is known from DE No. 1.060.329.

A disadvantage of the known dam wall systems is that due to the amount of play in the locks no watertight screen can be formed.

Watertightness of dam wall screens is extremely important when a site with contaminated groundwater has to be sealed from the surroundings.

The invention has for its object to provide an improved dam wall of the kind set forth in the preamble.

For this purpose such a dam wall is designed so that the dam wall profile is thin-walled —and thus has a very flexible cross-section—whilst the locks of the profile having a hook-like shape provide a tight closure. In a further development of the invention precautions can be taken in the hook-like locks for making them watertight after the disposition of the dam wall.

The advantages thereof are that with a watertight dam wall screen around building pits pumping costs are lower and in the event of contaminated groundwater a complete seal against the surroundings can be obtained. For effectively driving a profile in the ground it is provided with guide ridges extending near and parallel to a lock.

With reference to the drawing various embodiments will be discussed for explaining the invention.

Figure 2:
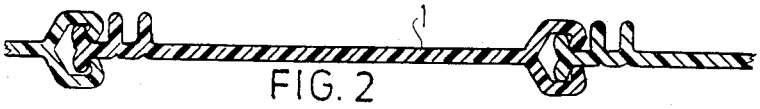
Figure 3:
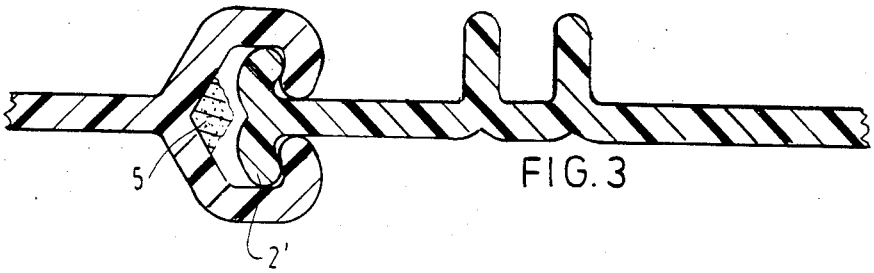
Figure 5:
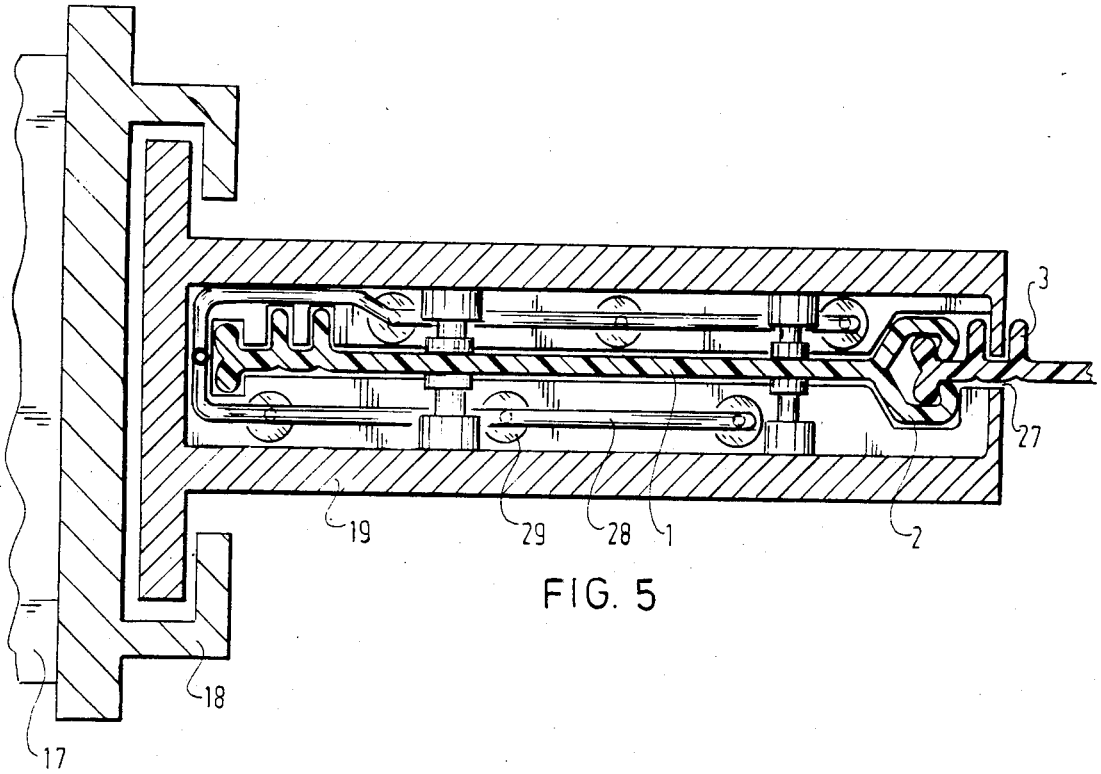
Figure 4:
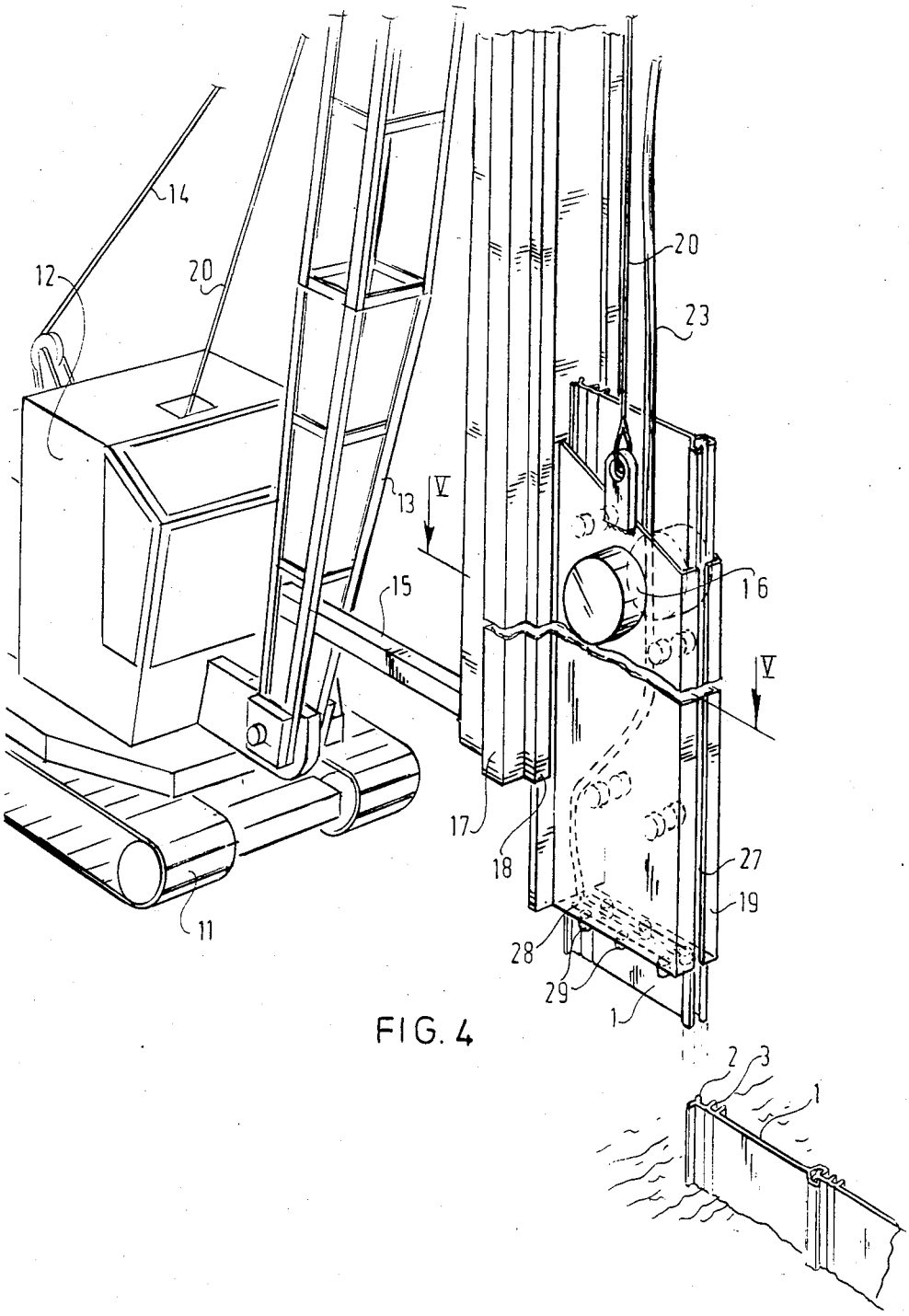

The drawing shows in:

FIG. 1 a cross-sectional view of a first embodiment of a profile in accordance with the invention, FIG. 2 is a cross-sectional view of a second embodiment, FIG. 3 is a cross-sectional view of part of the profile lock on an enlarged scale, FIG. 4 a perspective side elevation of a profile-driving or inserting machine, FIG. 5 is a cross-sectional view of the king post provided with a guide profile and an injection profile.

FIG. 1 shows a preferred embodiment of the dam wall profile 1 in a cross-sectional view. Behind the hooklike or dovertail lock 2 is located a continuous slot 4, which can be filled out from the ground surface with cement, bitumen or glue. In general it is possible to provide said slot in one or in both contact surfacaes of the hook-like connection 2. For satisfactorily guiding an injection profile 19 with a profile 1 and a spray tube 28 cams 3 are important (see FIG. 5). In order to obtain a most compact injection profile 19 it is necessary to arrange the guide ridges 3 most closely to the lock 2.

The profile 1 is very flexible in the direction of the smaller dimension of the cross-section. Both in an embodiment of thin stainless steel sheet and of a synthetic resin with a thickness of 5 mms the profile can be wound on a reel having a diameter of 2 meters. This has the advantage that no loss of dam wall lengths is involved, since after the insertion into the ground the dam wall can be cut off at the ground surface.

FIG. 2 shows in a cross-sectional view the dam wall profile. This also comprises an intimately fitting hook-like lock 2' (see also FIG. 3).

The dam wall profiles 1, 5 are preferably made from synthetic resinous material. The advantage is that the dam wall is not affected by any chemicals in the soil.

FIG. 3 shows the hook-like lock 2' on an enlarged scale, in which a swelling paste 5 or electric resistance wires (not shown) can be provided as an additional precaution for sealing and/or fusing the dovetail lock.

It will be noted that in both forms of the invention shown in FIGS. 1 and 2; each male interlocking means comprises a flanged portion along one side edge of the associated sheet and presents a pair of flanges projecting outwardly from respective opposite sides of the associated main body such that each flange defines an undercut trough. Each of the female interlocking means comprises a hollow portion presenting a recess having inwardly turned flanges at the entrance thereof and defining undercut troughs therebehind. This construction provides a dovetail interlocking intimate fit when the male and female interlocking means are interconnected with one another.

FIG. 4 shows the driving/insertion machine, which is usually a dragline 12 on caterpillars 11. The boom 13 is held in position by means of the stay wire 14. With the aid of the boom 13 and the extension arm 15 the king post 17 is usually held in a vertical position. The king post 17 has continuous guide profiles 18, a given length of which is covered by the injection profile 19. The driving or pushing effort can be produced by vibratory members 16 on the injection profile 19. The injection profile 19 can be drawn out of the ground with the aid of a pull wire 20 passed around top pulleys. The spray tube 28 is located in the injection profile 19, but it may be formed by a flexible hose 23 outside the injection profile.

FIG. 5 shows the cross-sectional view V—V of FIG. 4 There is shown a section of the king post 17, the guide profile 18 and the injection profile 19 held therein with the slot-like opening 27, the spray tube 28 with the spray nozzles 29 and the dam wall profile in the guide profile.

The method of driving profiles one by one into the ground is performed as follows:

Each time a profile is clamped in the guide 19, after which the profile is driven into the ground by means of the vibratory members 16, the profile 1 being moved therewith. Previously locking is initiated, after which the lock is further guided along the co-operating lock of the neighbouring profile, whilst the guide 19 sinks down along the ridge 3. The insertion is facilitated by loosening the earth by a water jet from the spray nozzles 29.

What is claimed is:

1. A sub-surface watertight barrier to prevent migration of liquid therethrough so as to isolate material on one side of the barrier from material on the other side of the barrier comprising a pair of sections each of which includes a main body portion of thin, flexible sheet material having male and female interlocking means respectively along opposite side edges thereof, each of said male interlocking means comprising a flanged portion along one side edge of the associated sheet and presenting a pair of flanges projecting outwardly from respective opposite sides of the associated main body, each flange defining an undercut trough, each of said female interlocking means comprising a hollow portion along the opposite side edge of the associated main body and presenting a recess having inwardly turned flanges at the entrance thereof and defining undercut troughs therebehind, the female interlocking means of one of said sections receiving the male interlocking means of the other of said sections in dovetail interlocking fashion to provide an intimate fit between said last mentioned male and female interlocking means, the terminal ends of said inwardly turned flanges of the female interlocking means of said one section being disposed closely adjacent opposite sides of the thin flexible sheet material of the other of said sections, the bottom of said recess of said one section defining a further trough spaced from the associated inwardly turned flanges to define a clearance space between said interfitting male and female interlocking means, and sealing means applied to the interior of said recess in said further trough thereof for sealing the dovetail interlock between said sections.

2. A section as defined in claim 1 including vibratory drive means for sinking the section into ground surface while being interlocked with a section previously sunk and including spray nozzle means for loosening the ground ahead of the section being sunk.

3. A section as defined in claim 1 wherein said main body portion is sufficiently thin as to allow longitudinal rolling thereof.

4. A section as defined in claim 2 wherein said section is made of synthetic resin.

5. A section as defined in claim 4 wherein said sealing means is a water-swellable agent.

* * * * *